US007196681B2

(12) United States Patent
Okuda

(10) Patent No.: US 7,196,681 B2
(45) Date of Patent: Mar. 27, 2007

(54) DRIVING CIRCUIT FOR LIGHT EMITTING ELEMENTS

(75) Inventor: Yoshiyuki Okuda, Tsurugashima (JP)

(73) Assignee: Pioneer Corporation, Tokyo (JP)

( * ) Notice: Subject to any disclaimer, the term of this patent is extended or adjusted under 35 U.S.C. 154(b) by 252 days.

(21) Appl. No.: 10/489,704

(22) PCT Filed: Sep. 17, 2002

(86) PCT No.: PCT/JP02/09482

§ 371 (c)(1),
(2), (4) Date: Mar. 15, 2004

(87) PCT Pub. No.: WO03/025894

PCT Pub. Date: Mar. 27, 2003

(65) Prior Publication Data

US 2004/0263436 A1 Dec. 30, 2004

(30) Foreign Application Priority Data

Sep. 18, 2001 (JP) ..... 2001-282780

(51) Int. Cl.
*G09G 3/30* (2006.01)
*G09G 5/00* (2006.01)
*G09G 3/10* (2006.01)

(52) U.S. Cl. ..... 345/76; 345/77; 345/211; 315/169.3

(58) Field of Classification Search ..... 345/76–83, 345/87, 92, 211–215; 315/169.1–169.3, 315/172

See application file for complete search history.

(56) References Cited

U.S. PATENT DOCUMENTS

| | | | | |
|---|---|---|---|---|
| 5,691,783 | A * | 11/1997 | Numao et al. | 345/92 |
| 6,201,520 | B1 * | 3/2001 | Iketsu et al. | 345/76 |
| 6,246,384 | B1 * | 6/2001 | Sano | 345/77 |
| 6,278,426 | B1 * | 8/2001 | Akiyama | 345/87 |
| 6,417,825 | B1 * | 7/2002 | Stewart et al. | 345/77 |
| 2001/0048410 | A1 | 12/2001 | Nishigaki et al. | |

FOREIGN PATENT DOCUMENTS

| | | |
|---|---|---|
| EP | 1 130 565 A1 | 9/2001 |
| EP | 1 193 676 A2 | 4/2002 |
| JP | 11-45071 | 2/1999 |

* cited by examiner

*Primary Examiner*—Amr A. Awad
*Assistant Examiner*—William L. Boddie
(74) *Attorney, Agent, or Firm*—Drinker Biddle & Reath LLP

(57) ABSTRACT

A display panel includes a number of light emitting elements arranged in a matrix fashion. A light emitting element driving circuit for use in the display panel can reduce fluctuations in brightness among the light emitting elements. A pulse supply circuit is formed so as to charge/discharge a capacitor based on a clock signal and drive the light emitting element based on the resulting discharge current. The amplitude of a drive current for each of the light emitting elements is not controlled by a transistor in a TFT circuitry, but controlled by external factors installed outside the display panel. The external factors may be a pulse supply circuit providing drive power source voltage and clock frequency. The external factors can be determined precisely.

14 Claims, 2 Drawing Sheets

DRIVING CIRCUIT FOR LIGHT EMITTING ELEMENTS

TECHNICAL FIELD

This invention relates to a driving circuit for light emitting elements arranged in a matrix in an image display panel.

BACKGROUND ART

In general, a TFT (Thin Film Transistor) drive circuit shown in FIG. 1 of the accompanying drawings is used as a drive circuit that drives each of pixels (each of light emitting cells) of a display panel when light emitting elements, such as organic electroluminescent materials (hereinafter, simply referred to as "organic ELs"), are arranged in a matrix fashion in the display panel. In FIG. 1, the cell is indicated by the broken-line square.

In FIG. 1, reference symbol Qa denotes a switching transistor for addressing, C denotes a memory capacitor that memorizes (holds) a voltage level of data, and Qb denotes a driving transistor that drives a load, i.e., organic EL light emitting element. Reference symbol EL denotes an organic EL light emitting element. The light emitting element EL has a structure in which an anode and a cathode sandwich an organic layer (or a layer which serves as an organic substance) that emits light. As depicted in the drawing, the light emitting element EL element has a rectifying property similar to that of a diode. In an actual display panel, the circuit shown in FIG. 1 constitutes each cell of the display screen, and a number of cells are arrayed in rows and columns (or X and Y directions) in a matrix on the screen.

The circuit of FIG. 1 operates as follows. First, a selection signal sent via an address line selects a desired cell out of a plurality of cells arranged in the display panel. The desired cell is a cell to emit. This selection signal turns the transistor Qa of the selected cell ON. Then the capacitor C of the same cell is electrically coupled with the data line, and the potential of the data line is memorized in the capacitor C. In other words, if the data on the data line is in an ON state, the data line potential is at a Hi level and the capacitor C is charged up to this Hi level potential. On the other hand, if the data is in an OFF state, its potential is at a Low level and the capacitor C is discharged down to the Low level potential.

Once the capacitor C has been charged up to the Hi level, the gate voltage of the transistor Qb is held at the Hi level until the Hi level data is replaced by a Low level data. Thus the transistor Qb continues to supply drain current to the load (i.e., organic EL light emitting element), and thereby the cell in which the Hi level data has been written continues to emit light. If a MOSFET (metal oxide semiconductor field effect transistor) is employed in the transistor Qb and such a drain-grounded circuit configuration shown in FIG. 1 is adopted, the input impedance of the transistor Qb will be substantially infinite. Then the potential of the capacitor C that has been charged does not decrease almost at all even if it is coupled with the transistor Qb.

In general, the electric property of low-temperature polysilicon TFT, which is often employed in the driving circuit for organic EL light emitting elements, is subject to nonuniformities. Particularly, if the Vgs-Id (gate-source voltage-drain current) properties of the drive transistors Qb are not equal to each other among cells, the drive transistors also fluctuate in mutual conductance among the cells. In other words, even if the individual capacitors C in cells are charged by the same Hi voltage, different drain currents run in the drive transistors. Because of such nonuniformities in driving current for organic EL among the cells, a nonuniform brightness pattern may appear on the display screen. It is like strewing sand over the screen surface.

DISCLOSURE OF INVENTION

An object of the present invention is to provide a driving circuit for a light emitting element that can reduce fluctuations in brightness among light emitting cells.

According to one aspect of the present invention, there is provided a light emitting element driving circuit that controls, based on a voltage value of a data line, an ON/OFF state of a light emitting element specified by a selection signal from an address line, comprising a first switching element that is controlled in accordance with said selection signal, a first capacitor that holds an electrical charge corresponding to the voltage value of the data line supplied via the first switching element, and a pulse supply circuit that provides the light emitting element with pulses in synchronization with a clock signal as long as the first capacitor holds the electrical charge.

A display panel includes a number of light emitting elements (and cells). Since the driving circuit can reduce the fluctuations in brightness among the light emitting elements, the quality of images displayed on the screen can be improved.

The pulse supply circuit may include first and second driving power sources, second and third switching elements serially connected between one terminal of the light emitting element and the first driving power source, a second capacitor having one terminal connected to the terminal of the light emitting element, and a fourth switching element that may have one common terminal and two independent terminals and have a switching function of connecting said common terminal to the two independent terminals alternately. The common terminal may be connected to the other terminal of the second capacitor. One of the two independent terminals may be connected to the second driving power source, and the other terminal may be connected to a reference potential. The second switching element may be controlled by the voltage value (electrical charge) held in the first capacitor. The third and fourth switching elements may be controlled in synchronization with each other based on the clock signal. It is possible to smoothly control the brightness of the entire display panel by changing a clock frequency for the driving power sources.

The fourth switching element may be shared by a plurality of light emitting elements in the display panel. The light emitting element may be an organic electroluminecent light emitting element.

DETAILED DESCRIPTION OF THE INVENTION

Figure 1:
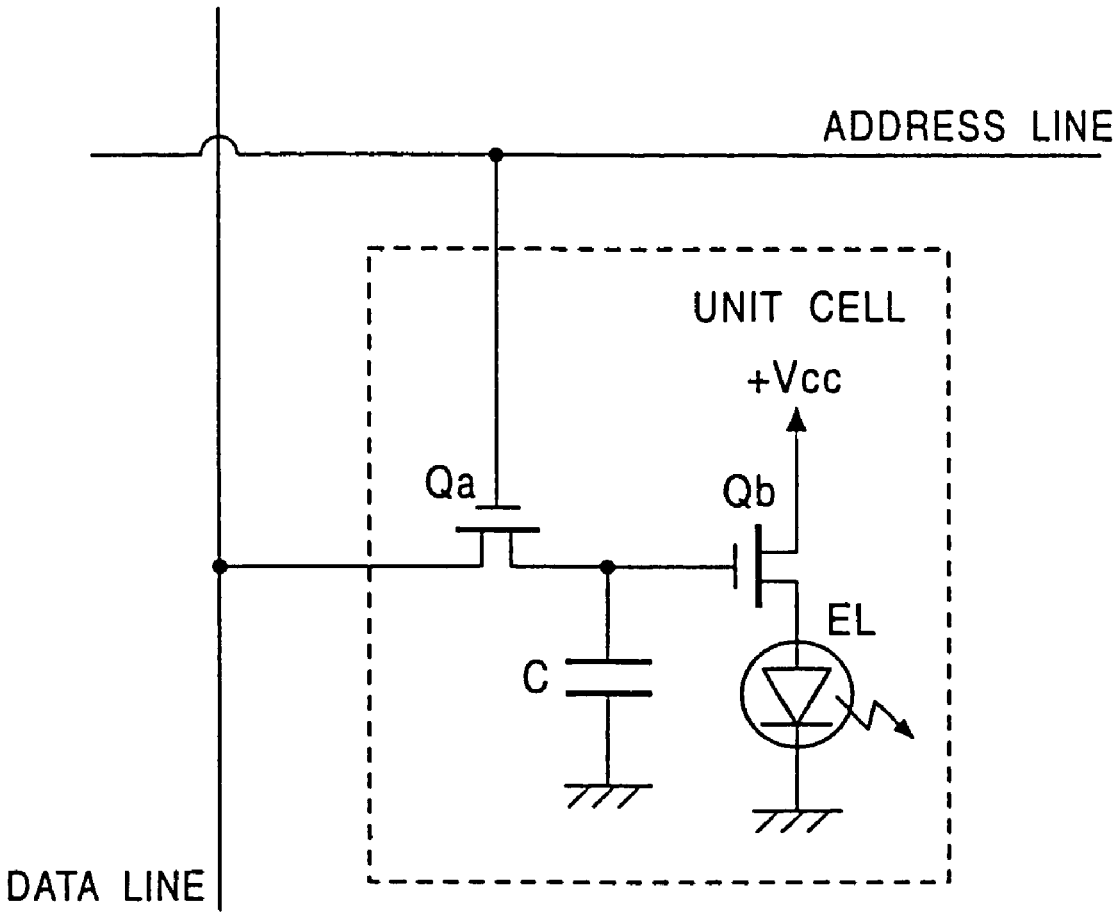
FIG. 1 PRIOR ART
FIG. 1 is a diagram showing a conventional drive circuit for an organic EL light emitting element.
Figure 2:
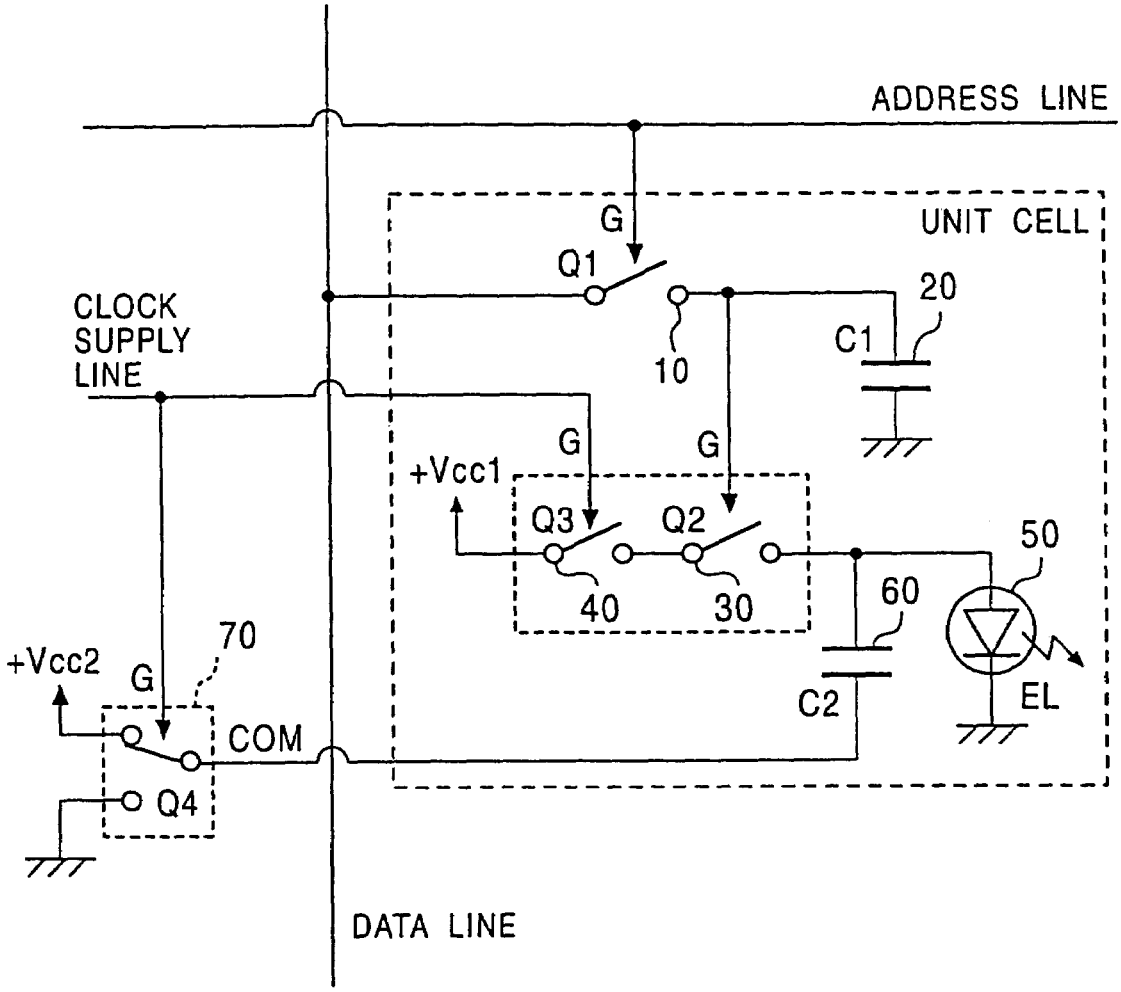
FIG. 2 is a diagram showing a drive circuit for an organic EL light emitting element in accordance with one embodiment of the present invention.

Referring to FIG. 2, a circuit diagram of an organic EL light emitting element driving circuit in accordance with one embodiment of the present invention is illustrated.

The configuration of the present embodiment is described with reference to FIG. 2. In this figure, a switching element Q1 (10) is a switching element of which ON/OFF state is controlled by a selection signal sent via an address line of a display panel. This switching element Q1 (10) can be made of, for example, bipolar transistor or FET. In the switching element Q1 (10), a gate terminal that controls the ON/OFF state of the switching element is connected to the address line. One terminal of the switching element is connected to a data line of the display panel, while the other terminal is connected to a capacitor C1 (20) that will be described later. The capacitor C1 (20), is a capacitor that memorizes data of the data line, namely, potential of the data line, taken in via the switching element Q1 (10). One terminal of the capacitor C1 (20) is connected to one terminal of the switching element Q1 (10), while the other terminal of the capacitor C1 (20) is grounded. The switching element Q1 (10) and the capacitor C1 (20) thereby constitute a data memory unit for the light emitting element driving circuit in accordance with the present embodiment.

A switching element Q2 (30) and a switching element Q3 (40) are switching elements made of bipolar transistor or FET, for example, as is the case with the switching element Q1 (10). The switching elements Q2 (30) and Q3 (40) are coupled in series, being fixed as shown in FIG. 2. Such a serial circuit branch may be composed by connecting two switching elements or by a dual-gate transistor. One terminal of the serial circuit branch composed of the switching elements Q2 (30) and Q3 (40) is connected to a first drive power source +Vcc1, while the other terminal is connected to the anode of the organic EL light emitting element (50), which will be referred to later, as well as to one terminal of the capacitor C2 (60). The gate terminal of the switching element Q2 (30) is connected to one terminal of the switching element Q1 (10) of the data memory unit, while the gate terminal of the switching element Q3 (40) is connected to a clock signal line of the display panel. The capacitor C2 (60) is a capacitor that temporarily memorizes the voltage level of the first driving power source. One terminal of the capacitor C2 (60) is connected to one terminal of the switching element Q2 (30) and the anode of the organic EL light emitting element (50), while the other terminal is connected to the common terminal of a switching element Q4 (70) that will be described later. The switching element Q4 (70) is what is called an alternate switch made of, for example, bipolar transistor or FET. Specifically, the switching element Q4 (70) connects the common terminal to two independent switching terminals alternately, based on the voltage applied to a gate terminal of the switching element Q4 (70). The gate terminal of the switching element Q4 (70) is connected to the clock signal line and a common terminal of the switching element Q4 (70) is connected to one terminal of the capacitor C2 (60). One of the two independent switch terminals of the switching element Q4 (70) is connected to a second driving power source +Vcc2, while the other terminal is grounded. The switching elements Q2 (30) and Q3 (40), capacitor C2 (60) and switching element Q4 (70) constitute the pulse supply unit for the light emitting element driving circuit in accordance with the present invention.

The organic EL light emitting element (50) is a light emitting element using organic electroluminescent materials, and it shows a rectifying property similar to that of a diode, as shown in the circuit diagram of FIG. 2. Namely, when a DC voltage higher than a predetermined threshold level for light emission is applied to the anode of the organic EL light emitting element (50), a forward current runs and the organic EL light emitting element (50) emits light. The anode of the organic EL light emitting element (50) is connected to one terminal of the switching element Q2 (30) and one terminal of the capacitor C2 (60), while the cathode of the organic EL light emitting element (50) is grounded.

Now described below is the circuit operation in the embodiment of FIG. 2. For a descriptive purpose, the light emitting element driving circuit according to the embodiment is divided into two major units, namely, the data memory unit and the pulse supply unit. It should be noted that the display panel includes a plurality of light emitting elements, and at least one of the light emitting elements is selected for light emission. A selection signal sent via the address line of the display panel selects the light emitting element. The organic EL light emitting element (50) shown in FIG. 2 is the selected element.

First, the operation of the data memory unit is described. In the data memory unit, the voltage level of the address line is raised to a Hi (high) level in order to select a desired light emitting cell, and this voltage is then applied to the gate terminal of the switching element Q1 (10) of the target light emitting cell. The switching element Q1 (10) is turned ON upon application of the high voltage, and the voltage level of the data line is memorized in the capacitor C1 (20). Specifically, the capacitor C1 (20) is charged up to the Hi level when the data line voltage is Hi, while discharged down to a Low level when the data line voltage is Low. Hi and Low levels of the data line voltage are related to the ON/OFF state of the organic EL light emitting element in the pixel of interest: Hi level of the data line voltage corresponds to the ON state of the organic EL light emitting element, while Low level to its OFF state.

When data writing in the capacitor C1 (20) has been completed, the address line voltage is pulled down to the Low level and therefore the switching element Q1 (10) turns OFF. The capacitor C1 (20) holds the voltage level indicative of this data status until the next data is written in. As apparent from FIG. 2, the non-grounded terminal of the capacitor C1 (20) is connected to the gate terminal of the switching element Q2 (30) of a pulse supply unit that will be described later. As a result, depending on the data line voltage level memorized in the capacitor C1 (20), the switching element Q2 (30) of the pulse supply unit also holds its ON or OFF state until the next data is written in.

Next described is the operation of the pulse supply unit. Now assume that there are following relationship between light emitting threshold voltage Vel for the organic EL light emitting element (50) and the voltages of the two driving power sources +Vcc1 and +Vcc2 in the pulse supply unit:

$$Vcc1+Vcc2>Vel$$

$$Vcc1<Vel$$

$$Vcc2<Vel.$$

As previously described, a clock signal is applied to the gate terminals of the switching elements Q3 (40) and Q4 (70) via the clock signal supply line in the pulse supply unit. The present embodiment assumes that such clock signals are pulse signals in which the voltage amplitude changes between Hi and Low levels alternately at predetermined intervals of time.

First, suppose that the clock signal voltage is at the Hi level and such voltage is applied to the gate terminals of the switching elements Q3 (40) and Q4 (70). In the embodiment, it is assumed that the switching element Q3 (40) is turned ON as the common terminal of the switching element Q4 (70) is switched to ground. Under such conditions, if the switching element Q2 (30) is turned ON based on the data stored in the capacitor C1 (20), one terminal of the capacitor C2 (60) is connected to the first driving power source +Vcc1 via the switching elements Q2 (30) and Q3 (40), while the other terminal of the capacitor C2 (60) is grounded via the switching element Q4 (70). As a result, the capacitor C2 (60) is charged up to the voltage level, +Vcc1, of the first deriving power source.

Next, suppose that the clock signal level has fallen to a Low level. Then the gate terminals of the switching elements Q3 (40) and Q4 (70) also fall to the Low level in voltage, the common terminal of the switching element Q4 (70) is switched to the side of the second driving power source +Vcc2. At the same time, the switching element Q3 (40) is turned OFF. As a result of such operation, the grounded terminal of the capacitor C2 (60) is now connected to the second driving power source via the switching element Q4 (70), so that the potential of this terminal is raised from zero volt to +Vcc2.

Note that when the clock signal is in the Hi level state, the capacitor C2 (60) has already been charged up to the first driving power source level, +Vcc1. Thus, if the clock signal voltage falls to the Low level, the potential of the electrode of the capacitor C2 (60) connected to the switching element Q2 (30) is pulled up to Vcc1+Vcc2 by the above described switching operation.

On the other hand, since the capacitor C2 (60) electrode is also connected to the anode of the organic EL light emitting element (50) and there is the relationship, Vcc1+Vcc2>Vel, as described before, such a potential increase makes the voltage applied to the organic EL light emitting element (50) exceed the light emitting threshold voltage Vel. Therefore, the organic EL light emitting element (50) becomes conductive, a drive current flows in the organic EL light emitting element (50), and the organic EL light emitting element (50) emits light.

If the static capacitance of the capacitor C2 (60) is represented by "C2", an amount of charge flowing into the organic EL light emitting element (50), qel, is expressed by the following equation:

$$qel=(Vcc1+Vcc2-Vel)\times C2.$$

The above operation is repeated in the pulse supply unit in each cycle of alternate switching between Hi and Low levels in the pulse waveform of the clock signal. Thus, if the cycle number of the clock signal per second (how many cycles the clock signal has in one second) is represented by fn(c/s), the average driving current Iel running in the organic EL light emitting element (50) per second is given by the following equation:

$$\begin{aligned} Iel &= qel \times fn \\ &= (Vcc1 + Vcc2 - Vel) \times C2 \times fn. \end{aligned}$$

If the data memorized in the capacitor C1 (20) of the data memory unit is OFF, or Low level voltage, the switching element Q2 (30) remains in an OFF state. Thus even if the clock signal switches the switching elements Q3 (40) and Q4 (70) on, the capacitor C2 (60) is not connected to the first driving power source +Vcc1, i.e., any driving current does not run in the organic EL light emitting element (50).

The cycle number for a clock signal can take on various values in the pulse supply unit based on the desired brightness of the organic EL light emitting element. For example, a clock signal may have one or more cycles within one addressing period during which data is written in. Alternatively, the clock signal may have a half or less cycle, i.e., one cycle may extend over two or more addressing periods. It should also be noted that the addressing period may be independent of the cycle number of clock signal.

According to the present embodiment, the drive current for the organic EL light emitting element (50) is determined by the following equation, as described before:

$$(Vcc1+Vcc2-Vel)\times C2\times fn.$$

It is possible to precisely control the voltages Vcc1and Vcc2of the first and second driving power sources by use of a separate (external), high-precision constant-voltage power supply circuit. It is also possible to precisely control the cycle number, fn, of the clock signal that drives the individual switching elements in the pulse supply unit by use of an external oscillation circuit. In other words, in the present embodiment, it is only the static capacitance of the capacitor C2 (60) that is determined inside the TFT driving circuit of the organic EL light emitting element. The static capacitance of the capacitor C2 (60) is determined by its electrode area, thickness of an insulator layer and dielectric constant of the insulator layer of the capacitor C2 (60). It is, therefore, relatively easy to precisely control the static capacitance of a capacitor during the fabrication of TFT circuitry, with less fluctuation, compared with the control of properties of TFT transistor.

When the display panel constituted by a plurality of cells is considered, a plurality of drive circuits are used for a plurality of organic EL light emitting elements respectively. If the drive circuit of the embodiment is associated with each of the organic EL light emitting elements in the display panel, it becomes possible to significantly reduce nonuniformities in driving current for the light emitting elements in the cells of the display panel.

Although the light emitting threshold voltage Vel changes with the ambient temperature, its fluctuation within the same display panel is almost negligible. Furthermore, if the potential difference between the light emitting threshold voltage Vel and driving power source voltages, Vcc1+Vcc2−Vel, is set at a large value, an influence of the fluctuating light emitting threshold voltage Vel with respect to driving current running in the light emitting elements becomes small.

Although the light emitting element in the embodiment of FIG. 2 is the organic EL light emitting element, the present invention is not limited to such a specific example. As the light emitting element, other types of elements such as inorganic EL light emitting elements and light emitting diodes may be used.

The switching element Q4 (70) shown in FIG. 2 may be associated with in each of the cells or may be shared by a plurality of cells. If the single switching element Q4 is shared by the cells, the circuit structure of each cell can be simplified.

It should be noted that the present invention is not limited to the described and illustrated embodiment. For example, the anode side of the organic EL light emitting element (50) may be grounded and the first and second driving power source voltages, Vcc1 and Vcc2, may be set at negative values.

Furthermore, a single, common power source may be used instead of the two separate power sources (i.e., the first driving power source +Vcc1 and second driving power source +Vcc2).

This application is based on a Japanese patent application No. 2001-282780 and the entire disclosure thereof is incorporated herein by reference.

The invention claimed is:

1. A light emitting element driving circuit for controlling, based on a voltage value of a data line, an ON/OFF state of a light emitting element specified by a selection signal from an address line, comprising:

a first switching element controlled in accordance with said selection signal;

a first capacitor for holding an electrical charge corresponding to the voltage value of said data line supplied via said first switching element; and a pulse supply circuit for providing said light emitting element with pulses in synchronization with a clock signal as long as said first capacitor holds said voltage value, wherein said pulse supply circuit includes:

first and second driving power sources;

second and third switching elements serially connected between one terminal of said light emitting element and said first driving power source;

a second capacitor having one terminal connected to said one terminal of the light emitting element; and a fourth switching element having one common terminal and two independent terminals for alternately connecting said common terminal to said two independent terminals, wherein said common terminal is connected to the other terminal of the second capacitor, and one of said two independent terminals is connected to said second driving power source, while the other terminal of said two independent terminals is connected to a reference potential, said second switching element being controlled by said voltage value held in said first capacitor, and said third and fourth switching elements controlled in synchronization with each other based on the clock signal.

2. The light emitting element driving circuit according to claim 1, wherein said fourth switching element is connectable to a plurality of light emitting elements.

3. The light emitting element driving circuit according to claim 1, wherein said first driving power source also serves as the second driving power source.

4. The light emitting element driving circuit according to claim 1, wherein said light emitting element is an organic electroluminescent light emitting element.

5. The light emitting element driving circuit according to claim 1, wherein each of said first, second and third switching elements includes one of a bipolar transistor and an FET.

6. The light emitting element driving circuit according to claim 1, wherein said second and third switching elements are configured as a dual gate transistor.

7. The light emitting element driving circuit according to claim 1, wherein said light emitting element is one of an inorganic EL light emitting element and a light emitting diode.

8. A display panel cell comprising:

a light emitting element controlled to be in one of an on/off state based on a voltage value of a data line, the light emitting element being selected for light emission by a selection signal supplied over an address line;

a first switching element controlled in accordance with said selection signal;

a first capacitor for holding an electrical charge corresponding to the voltage value of said data line supplied via said first switching element; and a pulse supply circuit for providing said light emitting element with pulses in synchronization with a clock signal when said first capacitor holds said voltage value, wherein said pulse supply circuit includes:

first and second driving power sources;

second and third switching elements serially connected between one terminal of said light emitting element and said first driving power source;

a second capacitor having one terminal connected to said one terminal of the light emitting element; and a fourth switching element having one common terminal and two independent terminals for alternately connecting said common terminal to said two independent terminals, wherein said common terminal is connected to the other terminal of the second capacitor, and one of said two independent terminals is connected to said second driving power source, while the other terminal of said two independent terminals is connected to a reference potential, said second switching element being controlled by said voltage value held in said first capacitor, and said third and fourth switching elements controlled in synchronization with each other based on the clock signal.

9. The display panel cell according to claim 8, wherein said fourth switching element is located outside of the cell and is connectable to a plurality of light emitting elements.

10. The display panel cell according to claim 8, wherein said first driving power source also serves as the second driving power source.

11. The display panel cell according to claim 8, wherein said light emitting element is an organic electroluminescent light emitting element.

12. The display panel cell according to claim 8, wherein each of said first, second and third switching elements includes one of a bipolar transistor and an FET.

13. The display panel cell according to claim 8, wherein said second and third switching elements are configured as a dual gate transistor.

14. The display panel cell according to claim 8, wherein said light emitting element is one of an inorganic EL light emitting element and a light emitting diode.

* * * * *